US006942528B2

(12) United States Patent
Brake

(10) Patent No.: US 6,942,528 B2
(45) Date of Patent: Sep. 13, 2005

(54) PLUG CONTACT ELEMENT AND A METHOD FOR MANUFACTURING A HOUSING PART FOR SAME

(75) Inventor: Jens Brake, Wuppertal (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/823,875

(22) Filed: Apr. 14, 2004

(65) Prior Publication Data

US 2004/0209526 A1 Oct. 21, 2004

(30) Foreign Application Priority Data

Apr. 14, 2003 (DE) ..... 103 17 145

(51) Int. Cl.[7] ..... H01R 11/22
(52) U.S. Cl. ..... 439/852; 439/275
(58) Field of Search ..... 439/852, 851, 439/587, 275, 274, 125; 438/672

(56) References Cited

U.S. PATENT DOCUMENTS 5,082,462 A * 1/1992 Oswald, Jr. ..... 439/851
5,607,328 A * 3/1997 Joly ..... 439/852
5,643,018 A * 7/1997 Sakai et al. ..... 439/852
5,679,019 A * 10/1997 Sakai et al. ..... 439/275
6,264,509 B1 * 7/2001 Kwang et al. ..... 439/852
6,290,554 B1 * 9/2001 Makita et al. ..... 439/852
6,475,040 B1 * 11/2002 Myer et al. ..... 439/852
6,527,601 B2 * 3/2003 Chen ..... 439/852

* cited by examiner

*Primary Examiner*—Gary Paumen
(74) *Attorney, Agent, or Firm*—David P. Wood

(57) ABSTRACT

The plug contact element for the at least partial pushing through an opening, in particular a round opening, in an elastic material along a push through direction of the plug contact element comprises a housing part having at least two wall regions which are substantially planar and inclined with respect to one another at least at a front side of the housing part and which are connected to one another via an arched or bent connection region, with the housing part having at least one indentation which opens to a front side of the housing part which lies in the push through direction and of which the indentation edge at least partly forms a front-side edge of the arched or bent connection region, with the indentation edge having an apex or a tangent which is orthogonal to the push through direction, the apex or tangent being provided only at the boundary between the connection region and one of the bordering wall regions or at one of the bordering wall regions.

15 Claims, 3 Drawing Sheets

PLUG CONTACT ELEMENT AND A METHOD FOR MANUFACTURING A HOUSING PART FOR SAME

TECHNICAL FILED

The present invention relates to a plug contact element and in particular to a plug contact element for the at least partial pushing through an opening, in particular a round opening, in an elastic material, and to a method for the manufacture of a housing part of a plug contact element of this kind.

BACKGROUND OF THE INVENTION

Plug contact elements are known in principle. They serve to connect two electrical leads to one another. For this purpose two mutually complementary plug contact elements, which can be plugged into one another, are electrically and mechanically connected to corresponding ends of the leads. In this arrangement, the plug contact elements as a rule have a mechanically stable, substantially rigid, housing part, which enables a plugging together of the plug contact elements.

In order to at least partly protect a plug contact element of this kind against moisture, it is often pushed through an opening in a seal of an elastic material. In this process, the seal can be formed as a block seal or be given by an areal piece of an elastic material, with the opening for pushing the plug contact element in or through in both cases being smaller than the cross-section of the plug contact element orthogonal to the push through direction in order that its opening edge lies sealingly in contact at the plug contact element or at a cable mantle of a cable which is connected to the plug contact element. In particular in the case that the sealing is to take place in the region of a cable or cable mantle which is connected to the plug contact element, these openings are mostly cylindrical, i.e. circular.

Known plug contact elements frequently have a housing part in the shape of a rectangular parallelepiped. The push through direction then extends parallel to one of the edges of the housing part. When plug contact elements of this kind are pushed through the opening of the seal, the seal however frequently tears at a section of the opening edge which lies in contact at the edge and which is particularly strongly stretched during the introduction of the plug contact element.

SUMMARY OF THE INVENTION

The object on which the present invention is based is therefore to create a plug contact element for pushing into an opening, in particular a round opening, in an elastic material in which a tearing of the elastic material at the edge of the opening is largely avoided, as well as a method for the manufacture of a housing part of a plug contact element of this kind.

This object is satisfied by a plug contact element having the features of claim 1.

The plug contact element for the at least partial pushing through an opening, in particular a round opening, in an elastic material along a push through direction of the plug contact element comprises a housing part having at least two wall regions which are substantially planar and inclined with respect to one another at least at a front side of the housing part and which are connected to one another via an arched or bent connection region, with the housing part having at least one indentation which opens to a front side of the housing part which lies in the push through direction and of which the indentation edge at least partly forms a front-side edge of the arched or bent connection region, with the indentation edge having an apex or a tangent which is orthogonal to the push through direction, the apex or tangent being provided only at the boundary between the connection region and one of the bordering wall regions or at one of the bordering wall regions.

The plug contact element in accordance with the invention has the housing part to which even further sections of the plug contact element can be connected, for example for contacting and/or mechanical connection to a lead.

The plug contact element is provided for the at least partial pushing through the opening in the elastic material, in particular in a seal element. The periphery of this opening can in particular be smaller than the periphery of the housing part at its front side which lies in the push through direction. In this situation, the push through direction can in particular extend substantially orthogonally to the front side of the plug contact element, i.e. parallel to a plugging direction which is defined by the construction of the housing part.

The housing part comprises at least two wall regions, which are formed substantially planar at least in the region of a front side of the housing part which lies in the push through direction. This is understood to mean that they have at most a curvature which is very much lower than the curvature of the connection region which connects them. In this context the wall regions need not, however, necessarily be formed in one piece, but rather can also be divided. The housing part can have even further sections, for example apertures, cut-outs or latching springs for the first latching of the plug contact element in a plug housing.

The connection region is arched or bent, preferably at least transversely to the push through direction. In this case, the curvature of the connection region can expediently be chosen such that no sharp edges arise which could lead to damage to the edge of the opening in the elastic material.

In order to facilitate the introduction of the plug contact element into the opening in the elastic material, at least one indentation is provided in the housing part, the indentation edge of which at least partly forms a front-side edge of the arched or bent connection region. The periphery of the housing part is hereby reduced at its front side, whereby the introduction of the plug contact element into the opening in the elastic material is facilitated in an initial phase if its diameter is smaller than the periphery of the housing part near the front side.

In accordance with the invention, the indentation is now formed such that the indentation edge has an apex or a tangent which extends orthogonal to the push through direction only at the boundary between the connection region and one of the bordering wall regions or at one of the bordering wall regions. This means that, in the connection region, the indentation edge has no such apex and no rounded portion with a tangent which is orthogonal to the push through direction. The opening edge can thereby be led past the indentation edge and stretched on pushing the plug contact element into the opening in the elastic material, with the opening edge however not being incident in the connection region at an edge which extends transversely to the push through direction and at which the edge can become caught or excessively stretched. An apex or a rounded portion of the indentation edge with a tangent which extends orthogonal to the push through direction is arranged only in the region at the boundary between the connection region and at the bordering wall regions or at the bordering wall region, where the opening edge then, however, extends parallel to the wall region. The opening edge can then in particular overstretch the apex or rounded portion so that it does not encounter a section of the indentation edge which extends orthogonally to the push through direction. A stretching of the edge of the opening can admittedly also arise, but no direct force transmission between the indentation edge and the edge of the opening takes place.

Moreover, forces can be exerted on the edge of the opening at different locations during the pushing in, so that the stress is distributed over an entire region and material fatigue is thus reduced.

In this way, peaks of the forces which act on the edge of the opening are avoided during the pushing through, which substantially reduces the risk of a tearing of the opening edge.

Through this change in the form of the indentation, a plug contact element in accordance with the invention can therefore be pushed into the elastic material, in particular a seal element, substantially without damage to the opening edge, even when the seal element is circular.

The plug contact element in accordance with the invention can preferably be manufactured as a bent part.

The object is further satisfied by a method for the manufacture of a housing part for a plug contact element in accordance with the invention, in which a sheet metal part which is to be bent is made available which has an indentation with an apex or rounded portion, and in which, for forming the housing part, the part to be bent is bent with two substantially planar wall sections, which are inclined with respect to one another and which are connected over an arched or bent connection region, along at least one line or one strip while forming the connection region such that the indentation edge has an apex or a tangent which extends orthogonally to the push through direction, the apex or tangent being provided only at the boundary between the connection and one of the bordering wall regions or at one of the bordering wall regions.

The method in accordance with the invention thus differs from known bending methods for the manufacture of plug contact elements among other things substantially in that the bending does not take place in the region of an apex or of a rounded portion with a tangent which extends orthogonally to a later push through direction.

A plug contact element in accordance with the invention can be particularly simply manufactured using this method.

Further developments and preferred embodiments of the invention are described in the description, the claims and the drawings.

The substantially planar wall regions preferably extend parallel to the push through direction. Thus, when the plug contact element is pushed through the opening in the elastic material, no stretching occurs which is caused by an enlargement of the periphery of the plug contact element. Moreover, plug contact elements of this kind are particularly simple to manufacture.

In the plug contact element in accordance with the invention it is furthermore preferred for the indentation to be asymmetrically formed in relation to a plane which bisects the angle between the wall regions. An indentation formed in this manner has, at least in a convex rounded portion, no tangent which extends orthogonally to the push through direction in the connection region, which reduces the risk of tearing of the edge of the opening. Furthermore, in this way, the area of the indentation can be kept very small. For this it is preferred, in the method in accordance with the invention, for the indentation to be asymmetrically formed in the sheet metal part which is to be bent.

It is furthermore preferred for the indentation edge to have substantially the shape of a "V" on an at least partly arched surface. In the method in accordance with the invention, it is accordingly preferred for the indentation in the sheet metal part which is to be bent to be substantially V-shaped. The sheet metal part which is to be bent can in this context be in particular planar. This particularly simple shape of the indentation enables a particularly simple pushing into a round opening of a seal, since the indentation edge extends smoothly in the region of the limbs of the "V" and the opening edge can be stretched continuously, i.e. without abrupt changes.

In this situation, it is particularly preferred for the indentation edge to extend substantially linearly at least in a section on one of the wall regions up to the arched or bent connection region and/or helically in the connection region. This means that, after the bending out of the housing part to a planar part, the indentation edge extends substantially linearly in the wall region and/or along the section which forms the connection region. In accordance with this, it is preferred in the method in accordance with the invention, for the indentation to have a linear edge section in the sheet metal part which is to be bent and for the bending to take place in the region of the linear edge section. Indentations formed in this manner enable a particularly simple pushing of the plug contact element through an opening in the elastic material without the material tearing at the edge.

In this situation, it is particularly preferred for the linear section of the indentation edge to subtend an angle between 10° and 45° to the push through direction. Accordingly, it is preferred in the method in accordance with the invention for the linear edge section to subtend an angle between 10° and 45° to the line or to the strip along which the sheet metal part is bent. Forming an inclination of this kind permits a very uniform, slow stretching of the opening in the elastic material, so that a tearing of the opening edge is hereby also avoided. Moreover, only lower forces are required for the at least partial pushing of the plug contact element through the opening.

In order to enable a simple manufacture, it is preferred for the housing part to be a single-piece bent part, in particular a stamped out bent part. In the method in accordance with the invention, it is accordingly preferred for the sheet metal part which is to be bent to be stamped from sheet metal. In this way, the sheet metal can be very simply brought into the desired shape.

It is furthermore preferred for the housing part to have at the front side at which the indentation is formed at least one bent around tongue which is connected to one of the wall regions. Depending on the nature of the bending, the introduction of the wall regions into the opening in the elastic material can hereby be simplified if the edge can be guided along the bent about tongue. Moreover, in a continuation of the bending the tongue can also, on the one hand, simplify the introduction of a contact tongue or of a contact pin through a corresponding guiding and, when designed accordingly, also push resiliently against the contact pin or the contact tongue and thus improve the contact.

In a preferred embodiment, the plug contact element in accordance with the invention is formed as a socket element. It can then in particular have at least two tongues which are bent around towards the housing interior and between which a contact tongue or contact pin can be pushed.

Alternatively, it is preferred for the plug contact element in accordance with the invention to have a contact tongue or contact pin which is held at or in the housing part or which forms a section of the housing part. A plug contact element of this kind can be particularly simply manufactured if the contact tongue or contact pin is introduced into a corresponding socket element and clamped firmly therein.

In particular for the case that contact tongues are to be used in the plug contact elements, it is preferred for the housing part to have at the front side four substantially planar wall regions, each of which subtends an angle which is smaller than 180°, preferably about 90°, to at least one of the others and is connected to the latter in each case via an arched or bent connection region; and for the housing part to have four indentations which open to the front side of the housing part which lies in the push through direction and of which the indentation edge in each case at least partly forms a front-side edge of the arched or bent connection region, with the indentation edge in each case having an apex or a tangent which is orthogonal to the push through direction, the apex or tangent being provided only at the boundary between the bordering connection region and the wall region which borders on the latter or at the wall region which borders on the bordering connection region. A contact element of this kind is very stable. If the wall regions in each case subtend an angle of 90° to one another, the wall regions extend substantially parallel to the push through direction, which facilitates pushing through an opening in an elastic material. A housing part of this kind furthermore corresponds in its symmetry to the one corresponding contact tongue and thus enables a particularly good contacting of the same.

A further subject of the invention is a contacting system comprising a plug contact element in accordance with the invention and a seal of an elastic material with a round, preferably circular, opening, through which the plug contact element can be at least partly pushed in its push through direction. It is particularly preferred in this system for the periphery of the opening in the seal to be smaller than the periphery of the plug contact element at the front side lying in the push through direction.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
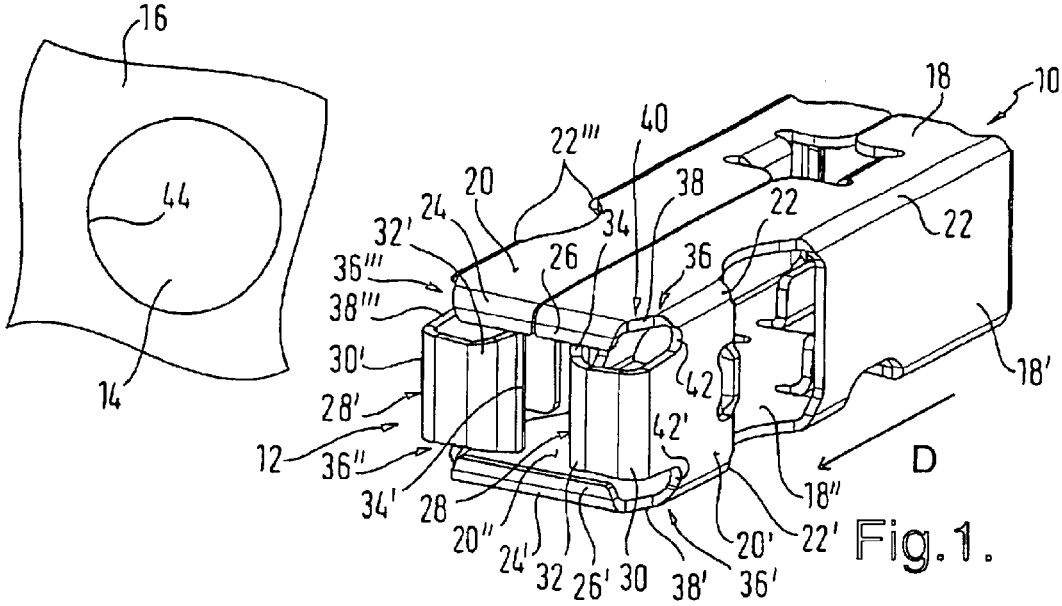
FIG. 1 is a perspective illustration of a housing part of a plug contact element in accordance with a first preferred embodiment of the invention, with a seal element.
Figure 2:
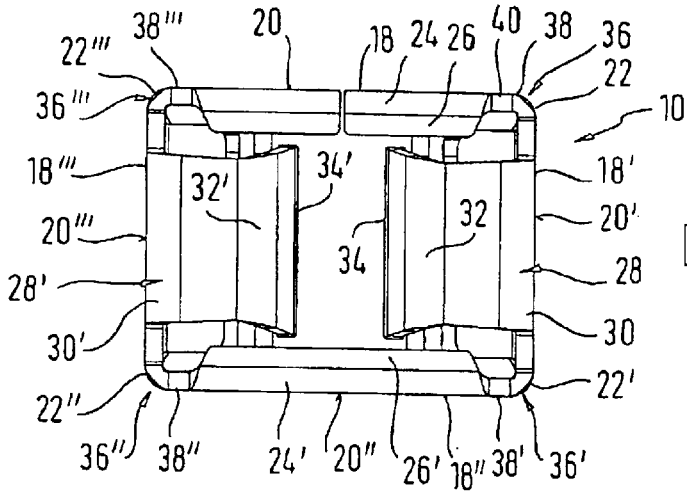
FIG. 2 is a front view of the plug contact element of FIG. 1.

A plug contact element in accordance with a first preferred embodiment of the invention has an elongate housing part 10 shown in FIGS. 1 and 2 which has substantially the shape of a right parallelepiped and can be pushed with a front side 12 into a circular opening 14 of a seal element 16 along a push through direction D which extends with respect to the longitudinal axis of the right parallelepiped.

The housing part 10 has four housing walls 18, 18', 18' and 18''' which extend substantially parallel to the push through direction D and which have planar wall regions 20, 20', 20' and 20''' at the front side 12 which lies in the push through direction. The housing walls and in particular the wall regions are thus mutually inclined at an angle of about 90°. Each of these housing walls 18, 18', 18' and 18''' and thus each of the wall regions 20, 20', 20' and 20''' is connected to two of the other housing walls or wall regions via corresponding bent connection regions 22, 22', 22' and 22''' which extend along the longitudinal edges of the right parallelepiped in the push through direction D.

The housing walls 18 and 18' are designed substantially analogously, with the housing wall 18, however, being divided along the push through direction D for reasons of the manufacture.

At the front side 12 the planar wall regions 20 and 20' merge into bent around first tongues 24 and 24', the planar first end sections 26 and 26' of which subtend an angle to the housing walls 18 and 18' respectively or to the wall regions 20 and 20' respectively and thereby to the push through direction D which is greater than 90°. Acting as guide surfaces, they can thus facilitate a pushing of the housing part 10 into the opening 14 in the seal element 16.

The housing walls 18' and 18''' are likewise formed symmetrically to one another. Their planar wall regions 20' and 20''' merge at the front side 12 into bent around second tongues 28 and 28' respectively, which are bent around to the interior of the housing part 10 in first bending regions 30 and 30' and second bending regions 32 and 32'. Like the first tongues 24 and 24', the first bending regions 30 and 30' respectively, which form rounded front-side outer edges of the housing part 10, act in this arrangement as guide surfaces during the pushing of the housing part 10 into the opening 14 of the seal element 16. The second end sections 34 and 34', which follow the second bending regions 32 and 32' respectively, serve as contact surfaces for a contact tongue of a complementary plug contact element which is to be pushed into the interior of the housing part 10.

Indentations 36, 36', 36' and 36''', the indentation edges 38, 38', 38' and 38''' of which in each case partly bound the wall regions 20, 20', 20'' and 20''' and the connection regions 22, 22', 22' and 22''' are provided at the edges of the housing part 10 in the region of the front side 12 which lies in the push through direction D.

The indentations 36, 36', 36' and 36''' are in each case formed alike or with mirror symmetry with respect to one another respectively, so that their design will be explained in the following with reference to the example of the indentation 36.

The indentation 36 has substantially the shape of a "V" on a surface which is partly planar and partly arched or bent like the connection region 22. In a first section 40, the indentation edge 38 at first extends linearly along the planar wall region 20 and then extends helically along a front side of the bent connection region 14 to merge into a rounded portion 42 at the wall region 20', which has a tangent extending orthogonally to the push through direction D only in the wall region 20'.

At the wall region 20' the indentation edge 38 extends further linearly in the direction of the front side 12 substantially parallel to the push through direction D.

The indentation 36 is therefore formed asymmetrically with respect to a plane which bisects the angle between the wall regions 20 and 20' .

This design of the housing part 10 enables a simple pushing into the opening 14 in the seal element 16 of elastic material, with its opening edge 44 not tearing, although its periphery is smaller than that of a cross-section of the housing part 10 transversely to the push through direction D. The pushing in proceeds, as shown in FIGS. 4 to 6, as follows.

Figure 4:
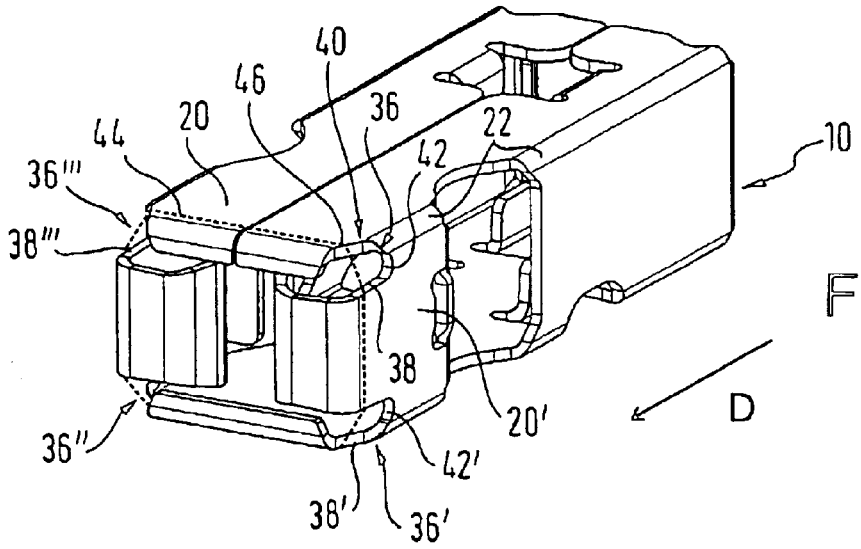
FIG. 4 is a perspective illustration of the housing part in FIG. 1 during pushing through an opening in the sealing element in a first stage.
Figure 5:
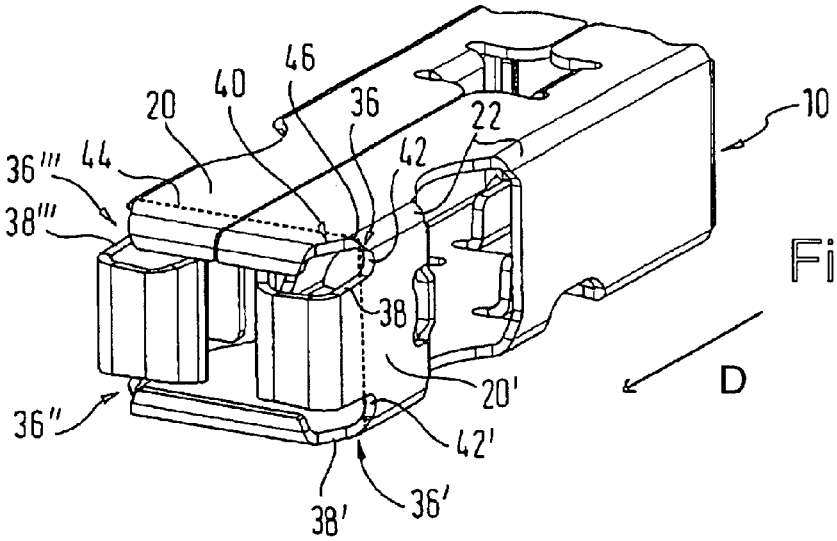
FIG. 5 is a perspective illustration of the housing part in FIG. 1 during pushing through an opening in the sealing element in a second stage.
Figure 6:
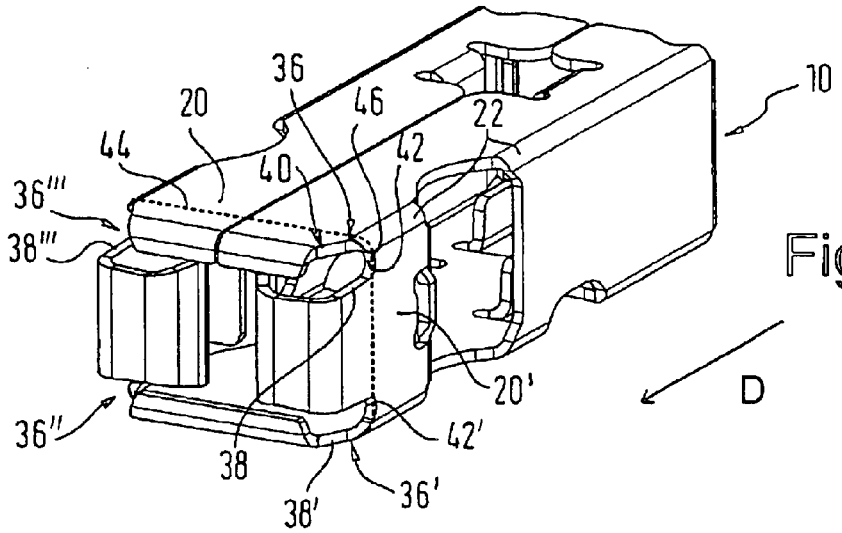
FIG. 6 is a perspective illustration of the housing part in FIG. 1 during pushing through an opening in the sealing element in a third stage.

At the beginning of the pushing of the housing part 10 into or through the circular opening 14 in the seal element 16 of an elastic material respectively, the opening edge 44, which is shown in broken lines in FIGS. 4 to 6, is stretched by the first tongues 24 and 24' and the first bending regions 30 and 30', with an excessive stretching in the region of the edges being avoided through the indentations 36, 36', 36' and 36''' which are formed at the edges of the housing part 10.

In a further pushing in (cf. FIG. 4), the opening edge 44 is guided, on the one hand, on the planar wall regions 20, 20', 20' and 20''' and, on the other hand, along the edges 38, 38', 38' and 38''' of the indentations 36, 36', 36' and 36''', so that the opening edge 44 spans the indentations 36, 36', 36'' and 36'''.

The processes in the region of the indentations 30, 30', 30' and 30''' will be explained in more detail in the following with reference to the indentation 30.

In this process, the opening edge 44 is stretched and guided in the direction towards the wall region 20' by the linear section 40 of the indentation edge 38, with a point of contact 46 between the indentation edge 38 and the opening edge 44 being moved along the opening edge 44 at the same time.

When the section of the indentation edge 38 at the connection region 22 (cf. FIG. 5) is reached, the point of contact 46 between the indentation edge 38 and the opening edge 44 runs on a helical line, so that the point of contact 46 does not encounter an edge region which extends orthogonally to the push through direction D.

Only when the rounded portion 42 is reached does an edge section which extends orthogonally to the push through direction D arise. In this stage, however, the opening edge 44 lies completely in contact at the wall regions 20 and 20' which border on the bent connection region 22 and on the connection region 22, with the rounded portion 42 being spanned linearly. In a further pushing in, the opening edge 44 does not encounter the front surface of the rounded portion 42 with a tangent which extends orthogonally to the push through direction D and can thus also not be blocked by it. In the further pushing in or through, an excessive stretching, which could lead to a tearing of the seal edge, can thus be avoided.

As a whole, through the uniform stretching of the opening edge 44 and the avoidance of a blocking, a tearing of the opening edge 44 is avoided.

Figure 3:
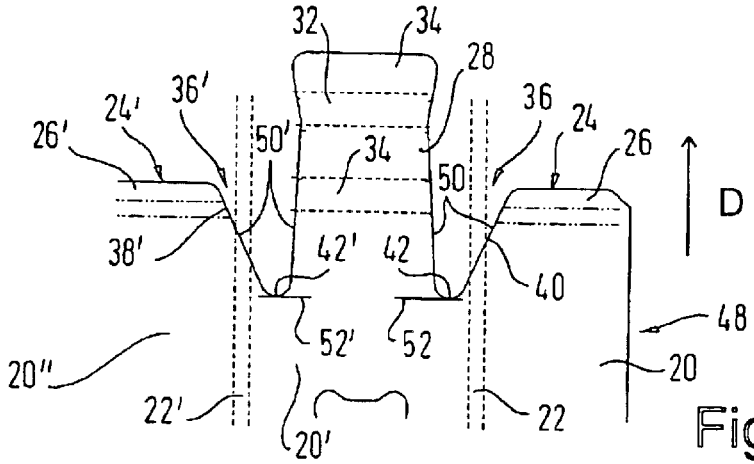
FIG. 3 is a plan view of a section of a stamped sheet metal part for the manufacture of the housing part in FIG. 1.

The plug contact element in accordance with the invention can be very simply manufactured as a stamped out bent part in that a sheet metal part 48 is stamped, a section of which is shown in FIG. 3. For corresponding sections before and after the bending the same reference symbols are used for the sake of clarity.

The indentations 36 and 36', each of which has the shape of a "V" with a rounded off apex or a rounded portion 42 and 42' respectively and linearly extending limbs 50 and 50' which are connected by them are formed between the first and second tongues 24 and 28 and 24' and 28'

The strips which will later extend parallel to the push through direction D and which produce the connection regions 22 and 22' after bending are in each case indicated by chain-dotted lines.

The indentation edges 38 and 38' have rounded portions 42 and 42' with tangents 52 and 52' respectively which extend orthogonally to the push through direction D or to the strips 22 and 22' respectively only in the wall region 20'.

After the manufacture of the stamped part, the first tongues 24 and 24' and the second tongue 28 are first bent about along the regions which are indicated by chain-dotted lines.

Then the wall regions 20 and 20' are bent by about 900 along the strips 22 and 22' with respect to the wall region 20', with the bending extending in the region of the linearly extending limbs 50, 50' of the indentation edges 38 and 38' respectively. In this way, the indentations which are shown in FIG. 1 are obtained.

In known plug contact elements, in contrast, which can likewise be manufactured as stamped out bent parts, the indentations are oriented symmetrically with respect to the strips 22 and 22' in the stamped sheet metal part which is to be bent, with the rounded portions of the indentations lying precisely in the bending regions.

Figure 7:
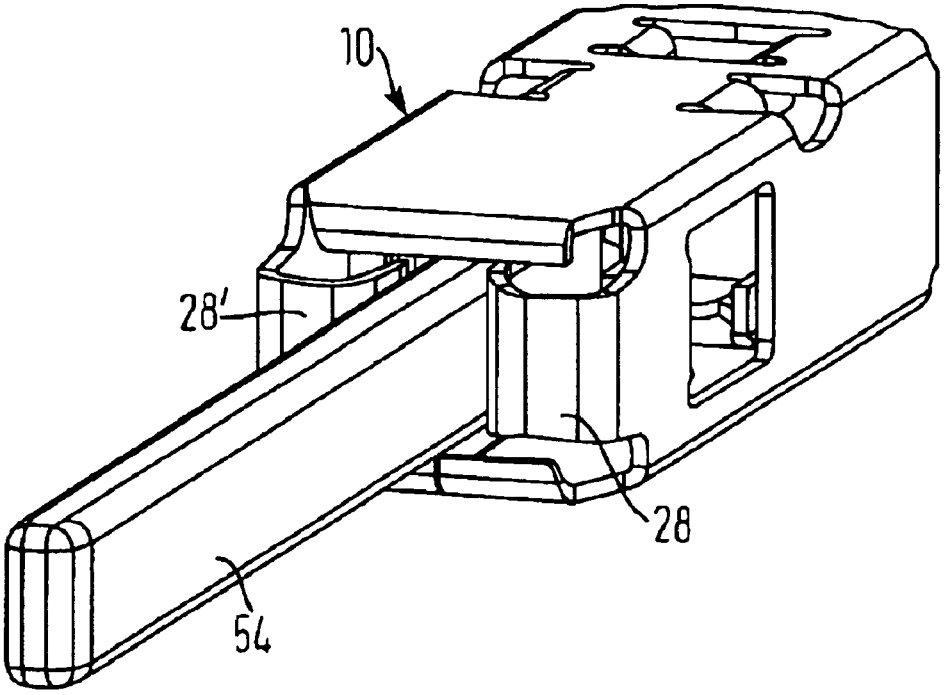
FIG. 7 is a perspective illustration of a plug contact element in accordance with a second preferred embodiment of the invention.

FIG. 7 shows a plug contact element in accordance with a second preferred embodiment of the invention, which differs from the plug contact element in FIG. 1 through a contact tongue 52 which is pushed into a housing part which is formed like the housing part 10 in the first exemplary embodiment.

After the manufacture of the housing part 10, the contact tongue 54 is pressed between the two tongues 28 and 28' and held there in a press fit.

In this way a plug contact element which is equipped with a contact tongue results in a simple way.

This plug contact element as well can be introduced as described above in a simple manner into an opening in a seal of an elastic material without damaging the edge of the opening.

What is claimed is:

1. A plug contact element for pushing through an opening in an elastic material along a push through direction of the plug contact element comprising: a housing part having at least two wall regions which are substantially planar and inclined with respect to one another at a front side of the housing part and which are connected to one another via an arched or bent connection region, the housing part having at least one indentation which opens to a front side of the housing part which lies in the push through direction and of which the indentation at least partly forms a front-side edge at the arched or bent connection region, an indentation edge having a tangent which is orthogonal to the push through direction, the tangent being provided only at the boundary between the connection region and one of the bordering wall.

2. A plug contact element in accordance with claim 1, wherein the indentation is formed asymmetrically in relation to a plane which bisects an angle between the wall regions.

3. A plug contact element in accordance with claim 1, wherein the indentation edge has substantially the form of a "V" on an at least partly etched surface.

4. A plug contact element in accordance with claim 1, wherein the indentation edge extends substantially linearly at least in a section on one of the wall regions up to the arched or bent connection region and/or helically in the connection region.

5. A plug contact element in accordance with claim 4, wherein the linear section of the indentation edge subtends an angle of between 10° and 45° to the push through direction.

6. A plug contact element in accordance with claim 1, wherein the housing part is a single piece bent part, in particular a stamped out bent part.

7. A plug contact element in accordance with claim 1, wherein the housing part has at least one bent around tongue which is connected to one of tie wall regions at the front side at which the indentation is formed.

8. A plug contact element in accordance with clam 1, wherein it has formed as a socket element.

9. A plug contact element in accordance with claim 1, wherein it has contact tongue or a contact pin which is held at or in the housing and or forms a section of the housing part.

10. A plug contact element m accordance with claim 1, wherein the housing part has four substantially planar wall regions at the front side, each of which subtends an angle which is smaller than 180°, preferably about 90°, with at least one of the others and is connected to the latter in each case via an arched or bent connection region; and in that the housing part has four indentations which open to the front side of the housing part which lies in the push through direction and of which the indentation edge in each case at least partly forms a front-side edge of the arched or bent connection region, with the indentation edge in each case having a tangent which is orthogonal to the push through direction, the tangent being provided only at the boundary between the bordering connection region and the wall region which borders on the latter or at the wall region which borders on the bordering connection region.

11. A method for the manufacture of a housing part for a plug contact element in accordance with claim 1, in which a sheet metal part which is to be bent is prepared which has an indentation with a grounded portion, and in which, for forming the housing part, the part to be bent is bent with two substantially planar wall sections which are inclined with respect to one another and which are connected over an arched or bent connection region along at least one line or one strip while forming the connection region in such a manner that the indentation edge has tangent which extends orthogonally to the push through direction, the tangent being provided only at the boundary between the connection region and one of the bordering wail regions.

12. A method in accordance with claim 11, wherein the indentation is formed asymmetrically in the sheet metal part which is to be bent.

13. A method in accordance with claim 11, wherein the indentation in the sheet metal part which is to be bent is substantially V-shaped.

14. A method in accordance with claim 11, wherein the indentation in the sheet metal part which is to be bent has a linear edge section; and in that the bending takes place in the region of the linear edge section.

15. A method in accordance with claim 11, wherein the sheet metal part which is to be bent is stamped out of sheet metal.

* * * * *